US008014548B2

(12) United States Patent
Stirnemann et al.

(10) Patent No.: US 8,014,548 B2
(45) Date of Patent: Sep. 6, 2011

(54) HEARING INSTRUMENT, AND A METHOD OF OPERATING A HEARING INSTRUMENT

(75) Inventors: Alfred Stirnemann, Zollikon (CH); Herbert Bächler, Meilen (CH)

(73) Assignee: Phonak AG, Stafa (CH)

( * ) Notice: Subject to any disclaimer, the term of this patent is extended or adjusted under 35 U.S.C. 154(b) by 1213 days.

(21) Appl. No.: 11/610,691

(22) Filed: Dec. 14, 2006

(65) Prior Publication Data

US 2008/0144868 A1 Jun. 19, 2008

(51) Int. Cl.
*H04R 25/00* (2006.01)

(52) U.S. Cl. ..... 381/312; 381/317

(58) Field of Classification Search ..... 381/312, 381/316, 317, 318, 320, 71.8, 71.11
See application file for complete search history.

(56) References Cited

U.S. PATENT DOCUMENTS

| | | | |
|---|---|---|---|
| 4,473,906 | A | 9/1984 | Warnaka et al. |
| 5,033,090 | A | 7/1991 | Weinrich |
| 5,740,258 | A | 4/1998 | Goodwin-Johansson |
| 6,445,799 | B1 | 9/2002 | Taenzer et al. |
| 6,937,738 | B2 | 8/2005 | Armstrong et al. |
| 2005/0013456 | A1 | 1/2005 | Chalupper et al. |

FOREIGN PATENT DOCUMENTS

| | | | |
|---|---|---|---|
| DE | 4010372 | A1 | 10/1991 |
| EP | 1499159 | A2 | 1/2005 |
| EP | 1681904 | A1 | 7/2006 |
| WO | 2004/021740 | A1 | 3/2004 |
| WO | 2005/052911 | A1 | 6/2005 |

OTHER PUBLICATIONS

Hellgren, Johan et al., "Variations in the feedback of hearing aids." Journal of the Acoustical Society of America, AIP/ Acoustical Society of America, Melville, NY, USA, vol. 106, No. 5, Nov. 1999, pp. 2821-2833.

European Search Report dated May 11, 2007 in reference to European Application No. EP06405517.1.

*Primary Examiner* — Tuan Nguyen
(74) *Attorney, Agent, or Firm* — Pearne & Gordon LLP

(57) ABSTRACT

A hearing instrument in accordance with the invention comprises an in-the-ear-canal component to be worn at least partially in the ear of a user. When the hearing instrument is worn, a remaining volume between the in-the-ear-canal component and the user's eardrum is defined. The hearing instrument includes at least one first microphone operable to convert an acoustic input signal incident on the hearing instrument into an electrical input signal, signal processing means operable to convert the electrical input signal into an electrical output signal on a signal path, and an electrical-to-acoustic converter (a receiver or a plurality of receivers with potentially different frequency characteristics). Between the remaining volume and surrounding atmosphere, a duct (such as a vent) is defined. A second receiver is in operative communication with the duct, i.e. an output directly opens out into the duct or to a sound conductor opening out into the duct. The hearing instrument further comprises a second microphone in operative communication with said duct and operable to record an error signal in said duct.

14 Claims, 2 Drawing Sheets

HEARING INSTRUMENT, AND A METHOD OF OPERATING A HEARING INSTRUMENT

FIELD OF THE INVENTION

The invention relates to a hearing instrument, in particular a hearing aid, and to a method for operating a hearing instrument.

BACKGROUND OF THE INVENTION

State of the art hearing instruments are usually either behind-the-ear (BTE) hearing instruments, in-the-ear (ITE) hearing instruments, in-the-canal (ITC) hearing devices or completely-in-the-canal (CIC) hearing instruments. ITE, and especially ITC and CIC hearing instruments are less visible than BTE hearing instruments and are therefore preferred by many users. However, in these devices the space in the ear canal has to be used efficiently, and the ear canal essentially has to be closed by the device so as to minimize acoustic feedback due to the proximity of the sound outlet of the receiver and the sound inlet of the microphone. This plugging of the ear canal may cause undesirable effects, known as occlusion effect which has an impact on the perception of the wearer's own voice and on the wearing comfort. The occlusion effect may also occur when BTE hearing instruments are used, since also BTE hearing instruments comprise a piece ("earpiece") placed in the ear canal, which is used for holding sound conduction tube(s) and/or other elements.

In this text, the term "earpiece" or "in-the-ear-canal component" is used to denote any device or device part of a hearing instrument that is meant to be placed at least partially in the ear canal of the user. It may for example be a ITE, ITC, or CIC hearing instrument. It may as an alternative be an earpiece (or otoplastic) of a hearing instrument which also comprises an outside-the-ear-canal component, for example a behind-the-ear component of a BTE. In the case of a BTE with an open fitting, the in-the-ear-canal component may merely be a fixation means for at least one sound tube. Concerning different types of in-the-ear-canal components and ways to connect them to a possible outside-the-ear-canal component, it is referred to the European patent application publication EP 1 681 904, the teaching of which is incorporated herein by reference.

In order to reduce the occlusion effect, in-the-ear-canal components comprising a "vent"—a duct through the in-the-ear-canal component—are used. Hearing instruments with large vents are especially popular, since the open fitting is perceived as very comfortable by the user. One of the reasons for this is that the occlusion effect is greatly reduced, and the own voice is perceived more naturally. However, large vents also have disadvantages.

a. Strong direct sound through the vent, which may not be controlled by the hearing instrument and which, due to delay differences, may interfere with the sound produced by the hearing instrument receiver.
b. Especially in ITE, ITC, and CIC hearing instruments, enhanced tendency for feedback, since the sound produced by the hearing instruments gets through the vent back to the microphone without substantial attenuation.
c. Reduced space: The space used up by the vent diminishes the design degrees of freedom, for example concerning the placement of a receiver in the instrument.

There are several proposals for dealing with sound conduction through ducts. The active control in ducts was proposed, for example in U.S. Pat. No. 4,473,906, to reduce noise carried through heating and ventilating ducts in factories and the like. Such systems rely on a first microphone placed along the duct which detects a noise signal, and a loudspeaker arranged downstream of the microphone that produces a compensation signal. In more advanced embodiments, there may be a second microphone for detecting a remaining signal to be minimized. Such active control systems, however, are as such not suitable for hearing instruments, since in hearing instruments the sound conduction tube is extremely short, and in hearing instruments sound conduction not only in one but in both directions is an issue.

Active direct sound compensation systems aim at the canceling of direct sound transmitted towards the eardrum, especially as active ear protection devices. Such active direct sound compensation systems have been described in the publications EP 1 499 159, U.S. Pat. No. 6,445,799, U.S. Pat. No. 5,740,258, and WO 2005/052911. EP 1 499 159, U.S. Pat. No. 6,445,799, and U.S. Pat. No. 5,740,258 describe combinations of a microphone with a loudspeaker that rely on the principle of evaluating, from the microphone signal, an inverse noise and radiating the inverse noise by the loudspeaker downstream of the microphone. WO 2005/052911 discloses a further example of such a feed forward noise canceller, which is suitable for attenuating sound signals bypassing the hearing instrument in situations where an auxiliary signal is received, for example through a wireless or wired connection, such as a telecoil. The wanted signal is fed to a receiver from an electrical input—such as a telecoil—whereas the signal of a microphone is fed to a noise cancellation part, which supplies a canceling signal to a receiver in the ear canal. An error microphone is used for adjusting the attenuating signal.

There are known disadvantages of such approaches. Firstly, no receiver is available with sufficient power for providing the compensation signal (inverse noise). Secondly, in practice it is difficult to separate between the wanted signal and the disturbing signal to be reduced. Thirdly, the electroacoustic transfer function in the excitation path (often mentioned as error path) is unfavorable with respect to the needed compensation filter. Finally, these approaches do not provide a solution to the problem of enhanced feedback due to there being a vent.

A further category of active systems for hearing instruments, therefore, deals with hearing instruments with no vent or only a small vent and with an active reduction of the occlusion effect. The disclosures of WO 2004/021740 and U.S. Pat. No. 6,937,738 are examples of such systems.

Yet a further category of systems deals with an active canceling of feedback through a vent. In U.S. Pat. No. 5,033,090 a microphone signal in the vent is used to improve the feedback tendency by way of suitable subtraction from the input signal. The vent microphone features the advantage that the unknown feedback path from the receiver to the vent microphone is taken into account. The remaining path from the vent microphone to the input microphone, however, is hard to estimate with sufficient accuracy, since the sound radiation from the vent to the concha scatters strongly from individual to individual. Thus, in practice, the estimation is difficult. Therefore, one may as well estimate the whole feedback path from the receiver to the input microphone. This is done in modern feedback cancellers. Such feedback cancellers, however, today have reached their limits in terms of impact and artifacts.

The European patent publication EP 1 499 159 describes, next to the above-mentioned cancellation of direct sound by means of a microphone and a receiver also the canceling of sound from the opposite direction. To this end, the sound is recorded by the microphone in the vent and is, via a compensation device, radiated at a different position in the vent. This disclosure thus relies on the same principle as above-described, and entails the same disadvantages. It features the additional disadvantage that two microphones have to be placed adjacent the vent.

SUMMARY OF THE INVENTION

It is an object of the invention to provide a hearing instrument comprising a vent that includes means for overcoming disadvantages of prior art hearing instruments and by which the acoustic feedback path is influenced and improved in an active way.

This object is achieved by the invention as defined in the claims.

A method of operating a hearing instrument in accordance with the invention comprises the steps of

- Obtaining an electrical input signal,
- Processing, on a signal path, the electrical input signal into an electrical output signal,
- Converting the electrical output signal into an output acoustic signal and emitting the output acoustic signal into a remaining volume between the in-the-ear-canal component and the user's eardrum,
- Taking a signal from the signal path, processing the signal into an electrical compensation signal, converting the electrical compensation signal into an acoustic compensation signal and emitting the acoustic compensation signal into a duct between the remaining volume and a surrounding atmosphere,
- Detecting a duct acoustic signal, and
- Adapting, based on the detected duct acoustic signal, at least one of processing parameters and of a processing structure for said processing the signal into an electrical compensation signal.

The acoustic compensation signal at least partially compensates by an active noise control process (also known as noise cancellation, or active noise reduction (ANR)) the signal in the duct and thus of the signal transmitted through the duct to the outside. In this way, the tendency for feedback is reduced. An additional effect may—depending on the chosen implementation—be that the direct sound that goes through the vent in the forward direction is also reduced, so that the wanted signal in the ear canal is easier to control.

The electrical input signal may be obtained by conversion, by a microphone or a plurality of microphones, of an incident acoustic signal. It may as an alternative be obtained by a receiving unit for signals transmitted to the hearing instrument wirelessly or by wire.

In the method according to the invention, the detected acoustic signal may be viewed as serving as an error signal in a closed-loop controller. The system under control is the entity that processes the signal taken from the signal path (also called the input signal of the compensation controller in the following) into the electrical compensation signal and transfers the latter into the acoustic compensation signal. The output of the system under control is the feedback canceling signal, and the reference value is the (inverse of) the acoustic signal that would be present in the duct if no compensation signal was emitted into the duct. The error signal in this closed-loop controller is determined acoustically and is recorded by a microphone (also called the 'second microphone' or 'error microphone' in the following) in operative communication with the duct.

A hearing instrument comprising an in-the-ear-canal component to be worn at least partially in the ear of a user, and at least one first microphone operable to convert an acoustic input signal incident on the hearing instrument into an electrical input signal, signal processing means operable to convert the electrical input signal into an electrical output signal on a signal path, and an electrical-to-acoustic converter for converting the electrical output signal into an acoustic output signal, the electrical-to-acoustic converter comprising at least one first receiver in operative communication with a remaining volume in front of the user's ear drum, the hearing instrument further defining a duct between the remaining volume and a surrounding atmosphere, and comprising a second microphone in operative communication with said duct and operable to record an acoustic signal in said duct, and further comprising a second electrical-to-acoustic converter in operative communication with said duct, wherein the signal processing means are operable to carry out the following steps:

- Tapping a signal from the signal path, processing the signal into an electrical compensation signal;
- Supplying the electrical compensation signal to the second electrical-to-acoustic converter; and
- Adapting, based on the recorded duct acoustic signal, at least one of processing parameters and of a processing structure for said processing the signal into an electrical compensation signal.

The digital signal processor may be a single digital signal processor unit or may be made up of different, potentially distributed units, preferably including at least one digital signal processor unit.

A hearing instrument in accordance with an other aspect of the invention comprises an in-the-ear-canal component to be worn at least partially in the ear of a user. When the hearing instrument is worn, a remaining volume between the in-the-ear-canal component and the user's eardrum is defined. The hearing instrument includes at least one first microphone operable to convert an acoustic input signal incident on the hearing instrument into an electrical input signal, signal processing means operable to convert the electrical input signal into an electrical output signal on a signal path, and an electrical-to-acoustic converter (a receiver or a plurality of receivers with potentially different frequency characteristics). Between the remaining volume and surrounding atmosphere, a duct (such as a vent) is defined. A second receiver is in operative communication with the duct, i.e. an output directly opens out into the duct or to a sound conductor opening out into the duct. The hearing instrument further comprises a second microphone in operative communication with said duct and operable to record an error signal in said duct. The hearing instrument further may comprise means for carrying out the method of operating a hearing instrument as defined above.

The hearing instrument preferably includes a compensation controller that is in operative connection with said signal path and is operable to convert a signal from the signal path into a compensation signal fed to the second receiver. An output of said second microphone is in operative connection with an auxiliary input of said compensation controller. The compensation controller is, in terms of hardware, not limited to a particular class of hardware. Thus it may comprise digital signal processing means, but may also be a passive filter the parameters of which are controllable. The compensation controller may be integrated with the signal processing means in a common unit—such as a digital signal processor, potentially including analog signal processing and/or amplifying means. It may as an alternative be a separate element such as a separate signal processor or comprise separate elements.

The second microphone may serve as an error microphone. Signal processing parameters—such as filter coefficients of an adaptive filter of the compensation controller—and/or a signal processing structure may be adjusted based on the signal recorded by the error microphone. As examples of different signal processing structures, the compensation signal may be switched off if the wanted signal is below a certain level, or different filtering methods may be chosen depending on the nature and/or dynamics of the incident acoustic signal.

The hearing instrument can be viewed as comprising a feed-forward compensation signal generator to obtain a compensation signal from the wanted signal or from a signal, and a closed loop adaptation of the compensation signal generator. In the adaptation loop, the acoustic signal incident on an error microphone is the error signal to be minimized, and the compensation signal generator processing parameters and/or processing structure are adapted.

The invention, thus, follows the principle that a compensation sound is generated based on the processed input signal itself—and not, as in some prior art systems, based on a signal recorded upstream or downstream in the duct. The error microphone, which is operable to record a duct signal, is merely used to influence processing parameters and/or a processing structure for establishing the compensation signal. The compensation controller may for example include the functionality of an adaptive filter, where the filter parameters are corrected based on the error microphone signal.

The approach according to the invention has the substantial advantage over prior art systems that there is no acoustical feedback path from the compensation receiver to an input of the compensation controller (since the second microphone merely detects an error signal to be minimized).

The output of the compensation controller may (apart from possible delays) be a monotonous function of the signal taken from the signal path. If the signal on the signal path is zero, the compensation receiver does not emit any signal, into the duct.

A compensation controller has at least two inputs: the first input from the signal path itself, processed in a real time, feed-forward manner into the compensation signal, and the auxiliary input from the error microphone by which the effect of the acoustic compensation signal may be surveyed and if necessary processing parameters may be adjusted. The processing of the duct acoustic signals into the processing parameters and/or processing structure can be done with a frequency corresponding to the sampling frequency or being of the same order of magnitude as the sampling frequency. It can as an alternative be done with a lower time-constant than the processing of the signal into the compensation signal. Then, the frequency with which the processing parameters are updated is comparably low, for example lower than the sampling rate of the acoustic input signal by an order of magnitude or more. This allows the error signal recorded by the error microphone (or a quantity dependent on it) to be integrated before processing, or the processing parameters to be (lowpass) filtered and/or integrated before being applied.

Due to the fact that the compensation signal is obtained from the signal path and not from the second microphone, and that the second microphone serves as an error microphone, it is not necessary that the second microphone is arranged upstream of the compensation receiver. The error signal may, in accordance with a preferred embodiment of the invention, be recorded in the same longitudinal position in which the acoustic compensation signal is radiated. This means that the compensation receiver and the error microphone are arranged at essentially the same position along the duct, i.e. the path of an acoustic signal from the compensation receiver intersects the duct at the same depth in the ear canal as the acoustic signal path to the error microphone. The possibility of arranging the compensation receiver and the error microphone at the same longitudinal position along the duct constitutes an important distinction from the prior art, where a microphone along the duct has to be place upstream of the compensation receiver. If the error microphone is at the same longitudinal position as the compensation receiver, the error signal recorded by the error microphone is a very good indicator of the efficiency with which the signal in the duct is cancelled by the compensation receiver.

It is, however, not a requirement that the compensation receiver and the error microphone (or the corresponding intersections of the acoustic signal paths with the duct) are at the same longitudinal positions. If they are not, an additional delay will result. In any case will the position of the error microphone be the place at which the acoustic signal in the duct is, at least for some frequencies, minimized.

The at least one error microphone and/or the at least one compensation receiver may be placed in the in-the-ear-canal component. As an alternative, compensation receiver(s) and/or error microphone(s) may be or in communication with in-the-ear-canal component by way of sound at least one sound conducting tube opening out into the duct.

Preferably, exactly one error microphone and exactly one compensation receiver is present.

The location of the error microphone (and thus preferably also of the compensation receiver) in the duct is chosen not to be too close to either end of it, i.e. preferably it is about in the middle of the duct. The position along the duct—in this text also called 'longitudinal position'—is defined to be the component parallel to an axis of the duct. Such an axis of the duct is approximately parallel to an axis of the ear canal. The duct need not be straight but may—as is well-known for vents—comprise curves etc., in which case the axis, along which the longitudinal position is measured is also curved. In the case of open fittings, the duct is defined by the ear canal, and the relevant quantity regarding positioning is a ratio between is a longitudinal distance $l_1$ between an outer end of the duct (here: ear canal) and a position of the error microphone (or a junction between the duct and a sound conductor connecting the duct with the error microphone) on the one hand, and a longitudinal distance $l_2$ between said position of the error microphone (or junction between the duct and a sound conductor connecting the duct with the error microphone) and an outlet into the remaining volume for sound produced by the first receiver(s). Also this ratio should not be too far away from 1, for example $0.05l_1<l_2<20l_1$, preferably $0.1l_1<l_2<10l_1$, especially preferred $0.25l_1<l_2<4l_1$. As an alternative measure, if the duct is a vent, the distance of the error microphone (or junction) from either end of the vent corresponds to preferably at least one or at least two or at least three vent diameters.

In practice, the quantities $l_1$, $l_2$ may be the result of an optimization process the result of which depends on the particulars of the hearing instrument.

DESCRIPTION OF THE PREFERRED EMBODIMENTS

Figure 1:
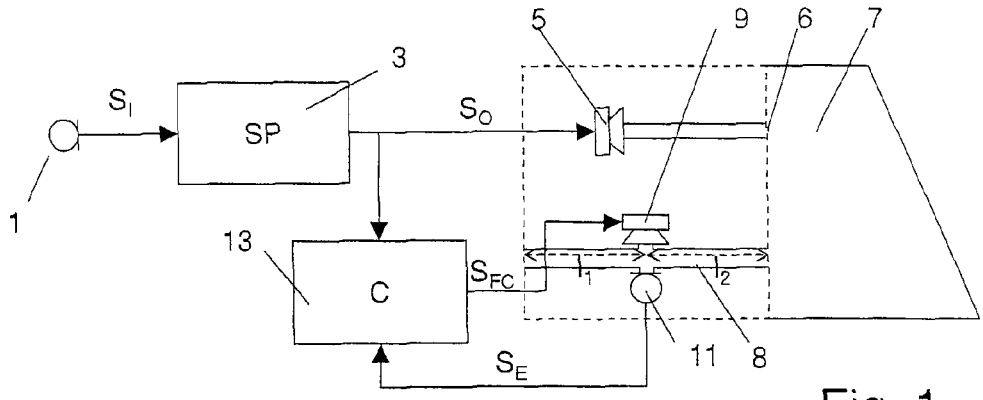
FIG. 1 shows a diagram of components of a hearing instrument according to a first embodiment of the invention.

The hearing instrument represented in FIG. 1 comprises an input microphone 1. In practice, often more than one input microphones are used, and/or in addition to the input microphone further receiving means for receiving signals may be present, such as a telecoil receiver, a receiving unit including an antenna for receiving wirelessly transmitted signals, etc. The electrical input signal $S_I$ obtained from the at least one input microphones is processed by a signal processing unit 3 to obtain an electrical output signal $S_O$. The electrical output signal is converted into an acoustic output signal by at least one receiver 5 and is emitted into a remaining volume 7 between the user's eardrum and the in-the-ear-canal-component of the hearing instrument. Between the remaining volume 7 and the surrounding atmosphere, a duct is present. The duct may be a vent 8 of the in-the-ear-canal-component, or it may be formed by the ear canal itself in the case of an open fitting. The hearing instrument comprises a second receiver 9 (or compensation receiver), which is operable to emit a compensation signal into the vent 8. The hearing instrument further comprises an error microphone 11 operable to convert an acoustic signal in the portion of the vent 8, which is irradiated acoustically by the compensation receiver, into an electrical error signal.

In the shown embodiment, thus, the (longitudinal) position along the length of the vent—approximately corresponding to the depth in the ear canal—of the microphone and of the receiver are approximately equal. In case the microphone and/or the receiver is/are not placed adjacent the vent but connected to the vent by way of sound conductors, the corresponding condition is that the longitudinal position of the junctions of the sound conductor(s) with the vent are equal, or are equal to the position of the microphone or receiver, respectively.

An other parameter to be considered is the longitudinal position itself of the positions of the compensation receiver and of the error microphone (or the respective longitudinal positions of the mentioned junctions). In this text, this position is represented by the lengths $l_1$ and $l_2$ of the two sections of the vent outward from the longitudinal position, and inside from the longitudinal position, respectively.

More in general $l_1$ is the longitudinal distance (i.e. the component of the distance parallel to the duct) between an outer end of the duct and the position of the error microphone or an inlet into the duct for guided to the error microphone. $l_2$ then denotes the longitudinal distance between said position (or inlet) and an outlet into the remaining volume 7 for sound produced by the first receiver(s) 5.

It has been found that if the place where the sound level is to be minimized (the place of the error microphone) is too far outside in the vent ($l_1 \ll l_2$) the efficiency becomes small, since the sound is almost short-circuited, and energy is wasted for sound emitted away from the user. If the place is too far towards the inner side ($l_1 \gg l_2$), then the wanted signal in the remaining volume is compensated away, i.e. erased by the compensation receiver.

Thus it is advantageous if $l_1 \approx l_2$. More concretely, it is for example $0.05l_1 < l_2 < 20l_1$, preferably $0.1l_1 < l_2 < 10l_1$, especially preferred $0.25l_1 < l_2 < 4l_1$, for example $0.5l_1 < l_2 < 2l_1$. The ratio $l_1/l_2$ may be used for optimizing the range in which the canceling is effective. Below a threshold frequency depending on $l_1/l_2$, the wanted signal of the first receiver may be reduced by the canceling system. Therefore, in any embodiment of the invention the compensation signal may be restricted to predefined frequency ranges, for example frequencies above a certain frequency threshold which depends on $l_1/l_2$.

The compensation signal (or feedback canceling signal) $S_{FC}$ fed to the compensation receiver 9 is obtained from a compensation controller 13 which calculates the compensation signal from the electrical output signal $S_O$. The electrical error signal $S_E$ obtained from the error microphone is fed to an auxiliary input of the compensation controller and serves for adjusting processing parameters for the signal procession by the compensation controller.

Thus, the real input signal of the compensation controller is not obtained from an additional microphone in the ear canal but is obtained directly as an electrical (digital or possibly analog) signal from the hearing instrument receiver input.

Figure 2:
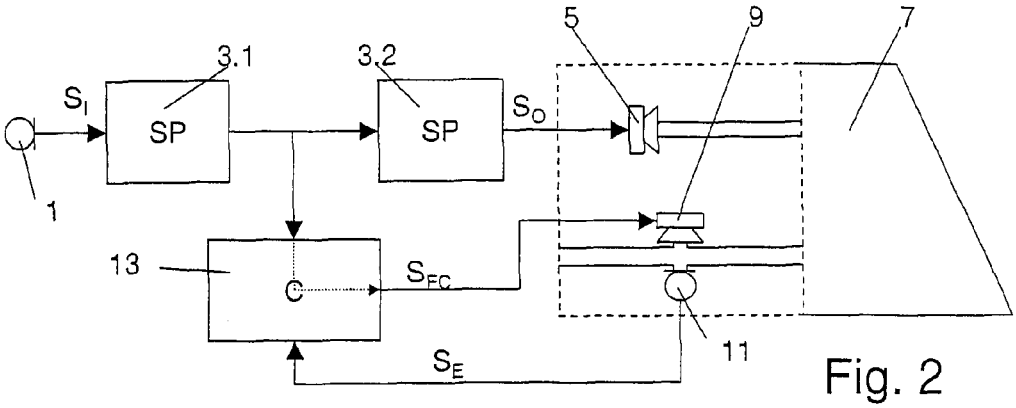
FIG. 2 shows a diagram of components of a hearing instrument according to a second embodiment of the invention.

As is illustrated in FIG. 2, instead of from the receiver input, the input signal of the compensation controller may also be tapped from different positions on the signal processing flow, thus on the signal path. The signal processing unit is illustrated as comprising a first stage 3.1 and a second stage 3.2, and in each stage one or a plurality of signal processing steps are carried out. In accordance with yet another variant, the signal may be tapped from the signal processing unit input. Preferred versions of the hearing instrument according to the invention, however, include obtaining the signal from the signal processing unit's output or from close thereto, so that signal processing steps carried out by the same are automatically taken into account when the compensation signal is determined.

Whereas in the drawings, the compensation controller is illustrated as a part separate from the signal processing unit, in practice the compensation controller may be integrated in one signal processing element, such as a digital signal processor or a signal processor that includes digital and analog elements. More in general, the hearing instrument may comprise one or a plurality of signal processing elements on which the functionality of the signal processing unit and of the compensation controller and potentially further functionalities are implemented.

Figure 3:
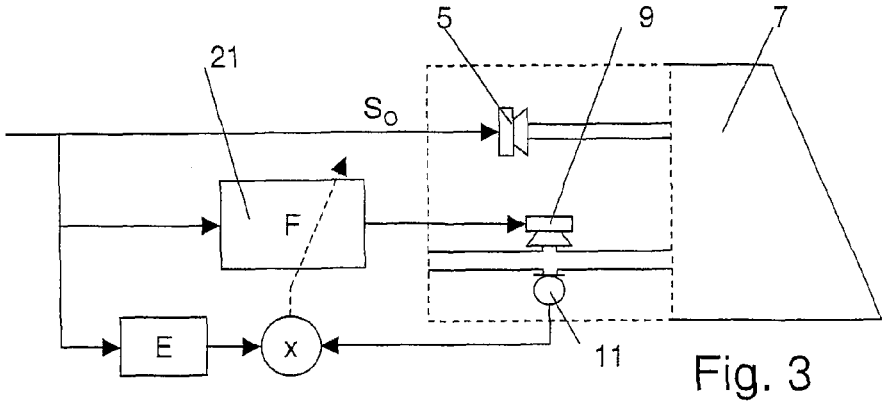
FIG. 3 depicts a diagram of components of a hearing instrument with details about the adaptive filtering.

FIG. 3 shows a potential realization of a compensation controller. The realization is based on a typical application of a filtered-x LMS algorithm as adaptive controller. The input signal of the adaptive filter 21 is the hearing instrument's wanted signal, namely the electrical output signal $S_O$. This signal is also filtered with a simulation of the error path E and is used, together with the error signal $S_E$ of the error microphone 11 as an input for the adaptation of the filter coefficients. Other realizations of the compensation controller—based on adaptive filtering or on other principles—are possible.

Figure 4:
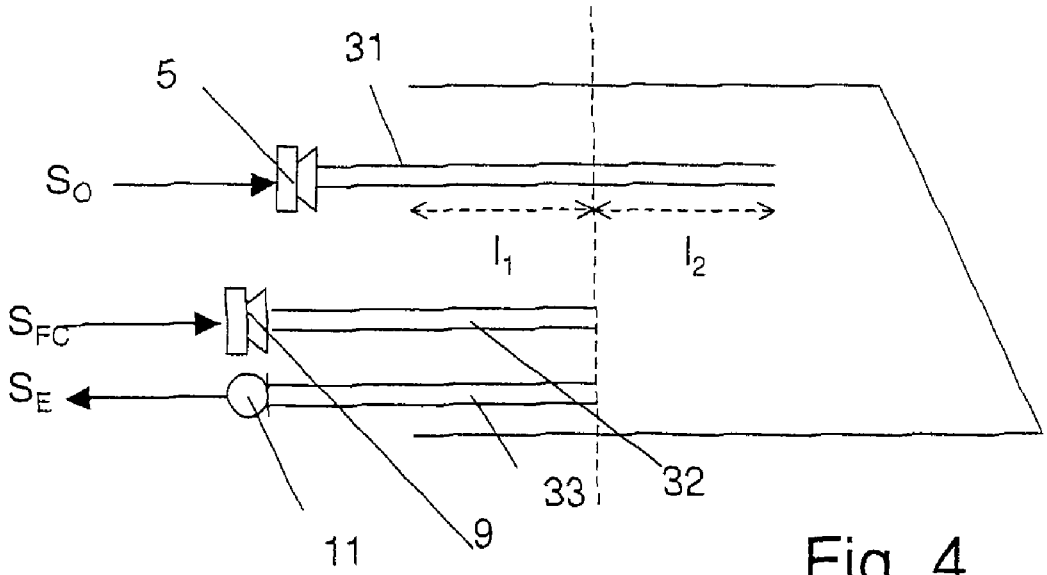
FIG. 4 depicts a scheme of feedback suppression in the case of an open fitting.

FIG. 4 shows an embodiment of the invention for an "open fitting" hearing instrument, i.e. for a hearing instrument that does not close off the ear canal. Instead of the vent, the duct is constituted by the open (except for tubing and (not shown) holders of the tubes) ear canal. Also in this case, the longitudinal positioning of the compensation receiver (and the corresponding error microphone) is a quantity to be considered preferably. The ratio $l_1/l_2$ also in this case is preferably between 0.25 and 4. This is achieved by choosing appropriate lengths of sound conducting tubes 31, 32, 33 for the first receiver(s) 5 and for the compensation receiver 9 and the error microphone 11.

Figure 5:
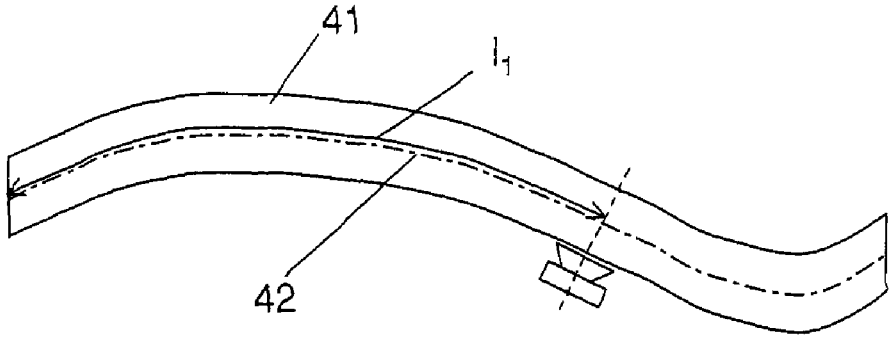
FIG. 5 shows a definition of longitudinal distances in case of a not straight duct.

FIG. 5 schematically shows, referring to the example of the distance $l_1$, how longitudinal distances between objects are defined in the case of a duct 41 that is not straight, namely as the distance between the intersections with the axis 42 of planes through the objects perpendicular to the axis. Even in cases where the duct does not have a constant cross section (such as if the duct is the ear canal itself), nevertheless a longitudinal axis can be defined.

In FIGS. 1-3, all of the first receiver(s), the compensation receiver and the error microphone are shown to be placed in the in-the-ear-canal component. The first microphone(s) may be placed within or outside of the in-the-ear-canal component. In FIG. 4, all of these elements are shown to be placed outside of the ear canal (for example in a behind-the-ear component of the BTE) and connected by sound conduction tubes to the respective outlets. Of course, also compromises between these variants are possible.

A special variant is to place the error microphone in the ear canal directly adjacent the vent of an in-the-ear-component and to place both, the first receiver(s) and the compensation receiver outside of the ear canal. This is advantageous if the space in the in-the-ear-canal component is especially scarce, since receivers tend to be comparably large-sized.

More in general, if the hearing instrument comprises, next to the in-the-ear-canal component, also an outside-the-ear-canal component, the following may hold: All of the first microphone(s), the first receiver(s), the compensation receiver, the error microphone, signal processing means and further components (such as battery compartments, communication modules for communication with further devices etc.), may be placed either in an outside-the-ear-canal component or in an in-the-ear-canal component. Arbitrary combinations are possible. However, preferably at least the signal processing means, a battery compartment and the first microphone(s) are placed in the outside-the-ear-canal component. The transducers (receivers, microphones) placed in the outside-the-ear-canal component are connected to the ear canal by means of sound conductors, such as tubes. The transducers are also connected to the signal processing means by data and/or power transmission means, such as wires, conductor paths of a printed circuit board, and/or non-contact signal transmission means.

Various other embodiments may be envisaged without departing from the scope and spirit of the invention.

What is claimed is:

1. A method of operating a hearing instrument, the hearing instrument comprising an in-the-ear-canal component to be worn at least partially in the ear of a user, the method comprising the steps of Obtaining an electrical input signal;

Processing, on a signal path, the electrical input signal into an electrical output signal;

Converting the electrical output signal into an output acoustic signal and emitting the output acoustic signal into a remaining volume between the in-the-ear-canal component and the user's eardrum;

Generating a feed-forward compensation signal by tapping a signal from the signal path, processing the tapped signal into an electrical compensation signal in real time, converting the electrical compensation signal into an acoustic compensation signal and emitting the acoustic compensation signal into a duct between the remaining volume and a surrounding atmosphere;

Detecting a duct acoustic signal; and

Minimizing the acoustic signal in the duct by using the detected acoustical signal in the duct as error signal and adapting, based on the detected duct acoustic signal, at least one of processing parameters and of a processing structure for said processing the signal into an electrical compensation signal.

2. The method according to claim 1, wherein the steps of emitting the acoustic compensation signal into the duct and of detecting the duct acoustic signal are both carried out at a same position along the duct.

3. The method according to claim 1, wherein, if $l_1$ denotes a longitudinal distance between an outer end of the duct and a position where the duct acoustic signal is detected, and if $l_2$ denotes a longitudinal distance between said position and a place at which the output acoustic signal is emitted into the remaining volume, then the inequality $0.1l_1<l_2<10l_1$ holds.

4. The method according to claim 1, wherein, if $l_1$ denotes a longitudinal distance between an outer end of the duct and a position at which the duct acoustic signal is detected, and if $l_2$ denotes a longitudinal distance between said position and a place at which the output acoustic signal is emitted into the remaining volume, then both, $l_1$ and $l_2$ each are greater than or equal to a diameter of the duct.

5. The method according to claim 1, wherein the detected duct acoustic signal is used as an error signal in said adapting at least one of processing parameters and of a processing structure for said processing the signal into an electrical compensation signal.

6. The method according to claim 5, wherein the step of processing the signal into an electrical compensation signal includes adaptive filtering, and wherein filter parameters for said adaptive filtering are adjusted based on said error signal.

7. A hearing instrument comprising an in-the-ear-canal component to be worn at least partially in the ear of a user, and at least one first microphone operable to convert an acoustic input signal incident on the hearing instrument into an electrical input signal, a signal processor operable to convert the electrical input signal into an electrical output signal on a signal path, and an electrical-to-acoustic converter for converting the electrical output signal into an acoustic output signal, the electrical-to-acoustic converter comprising at least one first receiver in operative communication with a remaining volume in front of the user's ear drum, the hearing instrument further defining a duct between the remaining volume and a surrounding atmosphere, and comprising a second microphone in operative communication with said duct and operable to record a duct acoustic signal in said duct, and further comprising a second electrical-to-acoustic converter in operative communication with said duct, wherein the signal processor is operable to carry out the following steps:

Generating a feed-forward compensation signal by tapping a signal from the signal path, and processing the tapped signal into an electrical compensation signal in real time;

Supplying the electrical compensation signal to the second electrical-to-acoustic converter;

Detecting a duct acoustic signal; and

Minimizing the acoustic signal in the duct by using the detected acoustical signal in the duct as error signal and adapting, based on the recorded duct acoustic signal, at least one of processing parameters and of a processing structure for said processing the signal into an electrical compensation signal.

8. The hearing instrument according to claim 7, wherein a path of an acoustic signal produced by said second receiver intersects the duct at the same position along said duct as an acoustic signal path to said second microphone.

9. The hearing instrument according to claim 7, wherein the signal processor is operable to use the detected duct acoustic signal as an error signal in said adapting at least one of processing parameters and of a processing structure for said processing the signal into an electrical compensation signal.

10. The hearing instrument according to claim 7, wherein the signal processor includes one digital signal processor unit or a plurality of digital signal processor units.

11. A hearing instrument comprising an in-the-ear-canal component to be worn at least partially in the ear of a user, and at least one first microphone operable to convert an acoustic input signal incident on the hearing instrument into an electrical input signal, a signal processing means operable to convert the electrical input signal into an electrical output signal on a signal path, and an electrical-to-acoustic converter for converting the electrical output signal into an acoustic output signal, the electrical-to-acoustic converter comprising at least one first receiver in operative communication with a remaining volume in front of the user's ear drum, the hearing instrument further defining a duct between the remaining volume and a surrounding atmosphere, and comprising a second microphone in operative communication with said duct and operable to record an acoustic signal in said duct, and further comprising a second receiver in operative communication with said duct, wherein a path of an acoustic signal produced by said second receiver intersects the duct at the same position along said duct as an acoustic signal path to said second microphone, the hearing instrument further comprising a compensation controller, wherein an input of said compensation controller is in operative connection with said signal path, and wherein an output of said second microphone is in operative connection with a further input of said compensation controller, and wherein the compensation controller is operable to convert a signal from the signal path into a compensation signal fed to the second receiver, and wherein the compensation controller is further operable to adapt, based on an error signal input from the second microphone, at least one of processing parameters and of a processing structure for said processing the signal into an electrical compensation signal.

12. The hearing instrument according to claim 11 wherein the signal processing means and the compensation controller each comprise a digital signal processing stage, and wherein the digital signal processing stages of the signal processing means and of the compensation controller are both formed by a common digital signal processor.

13. The hearing instrument according to claim 11, wherein said compensation controller comprises an adaptive filter, and is operable to adapt, based on an error signal input from the second microphone, filter constants of said adaptive filter.

14. The hearing instrument according to claim 11, wherein, if $l_1$ denotes a longitudinal distance between an outer end of the duct and a position at which the second microphone records the acoustic signal, and if $l_2$ denotes a longitudinal distance between said position and an inner end of the duct, then both, $l_1$ and $l_2$ each are greater than or equal to a diameter of the duct.

* * * * *